US006624560B2

(12) United States Patent
Usami

(10) Patent No.: US 6,624,560 B2
(45) Date of Patent: Sep. 23, 2003

(54) DEFLECTION YOKE

(75) Inventor: Yoshihiko Usami, Greensburg, PA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/862,663

(22) Filed: May 22, 2001

(65) Prior Publication Data

US 2002/0175613 A1 Nov. 28, 2002

(51) Int. Cl.[7] ..... H01J 29/70

(52) U.S. Cl. ..... 313/440; 335/209; 335/210; 335/296

(58) Field of Search ..... 313/440, 441, 313/442; 335/210, 212, 213, 209, 296

(56) References Cited

U.S. PATENT DOCUMENTS

| | | | | |
|---|---|---|---|---|
| 4,041,428 A | | 8/1977 | Kikuchi et al. | 335/210 |
| 4,260,974 A | | 4/1981 | Nelle | 335/213 |
| 4,267,541 A | | 5/1981 | Narikiyo | 335/212 |
| 4,376,273 A | | 3/1983 | Shisler et al. | 335/213 |
| 4,882,521 A | * | 11/1989 | Arimoto | 313/440 |
| 5,121,028 A | | 6/1992 | Milili | 313/440 |
| 5,142,205 A | | 8/1992 | Yabase et al. | 315/368.26 |
| 5,408,163 A | | 4/1995 | Milili et al. | 315/370 |
| 5,418,422 A | | 5/1995 | Vink et al. | 313/440 |
| 5,818,159 A | | 10/1998 | Dossot et al. | 313/440 |
| 5,838,099 A | | 11/1998 | Hichiwa et al. | 313/440 |
| 6,069,546 A | | 5/2000 | Azzi et al. | 335/210 |
| 6,084,490 A | * | 7/2000 | Azzi et al. | 313/440 |
| 6,351,200 B1 | | 2/2002 | Azzi et al. | 335/213 |
| 6,456,943 B1 | | 9/2002 | Kogure et al. | 702/23 |

* cited by examiner

*Primary Examiner*—David Martin
*Assistant Examiner*—Thanh Yen Tran
(74) *Attorney, Agent, or Firm*—Mayer Fortkort & Williams, PC; Michael P. Fortkort; Karin L. Williams

(57) ABSTRACT

A depression in the windings of a horizontal coil at a predetermined location in a deflection yoke of a cathode ray tube corrects for multiple types of mis-convergence. In particular, the depression in the windings is disposed in a "neck" portion of the deflection yoke, which incorporates a horizontal deflection coil disposed on a saddle type mold die. A deflection yoke for deflecting electron beams of a color CRT includes a horizontal deflection coil disposed on a saddle type mold die that has a funnel section and a neck section connected along a horizontal axis parallel to the centerline of the deflection yoke. A portion of the neck section of the deflection yoke includes an offset relative to the profile (relative to the horizontal axis) of the windings of the horizontal coil that creates a depressed area in the windings of the horizontal deflection coil. The location of the depression is selected by partitioning the length of the horizontal coil into four substantially equal segments; and then placing the depression in the second of the four segments.

20 Claims, 6 Drawing Sheets

MOLD DIE PIN SHOOT TYPE COIL

DEFLECTION YOKE

BACKGROUND OF THE INVENTION

The present invention relates generally to cathode ray tubes, and more particularly to a cathode ray tube incorporating a deflection yoke with a horizontal deflection coil disposed on a saddle type mold die.

An important aspect of performance for a television monitor is its ability to correctly align the individual color components projected onto the screen of the monitor (e.g., red, green and blue). Convergence describes how far apart the three electron beams spread from one another within a pixel in a CRT. In an ideal situation, the beam strikes all three dots without hitting any adjacent groups. Mis-convergence is a quantitative measurement of the lack of proper convergence of the three electron beams. Where mis-convergence occurs, the resulting image will have a shadowed appearance.

A deflection yoke is used to control the convergence of the three electron beams (e.g., red, green and blue) in a Cathode Ray Tube (CRT) by altering the winding distribution in the horizontal and vertical coils to compensate for mis-convergence. For example, U.S. Pat. No. 5,838,099 discloses one such deflection yoke.

There are several patterns related to mis-conversion in CRTs. Examples are XH, HCR, PQV, PQH, S3V and Top/Bottom Pin. These are the key parameters for a Horizontal Coil.

Referring to FIGS. 1A through 1E, depicted therein are various patterns of mis-convergence. In FIG. 1A, the mis-convergence is referred to as XH mis-convergence. In XH mis-convergence, the plus patterns of the red (R) and blue (B) lines fail to converge. FIG. 1B shows HCR mis-convergence. In HCR mis-convergence, the plus patterns of the green (G) line fail to converge with the plus patterns of the of the red (R) and blue (B) converged lines. FIG. 1C shows PQV mis-convergence. In PQV mis-convergence, the red (R) and blue (B) lines fail to converge horizontally at the vertical extents of the CRT as shown. FIG. 1D shows PQH mis-convergence. In PQH mis-convergence, the red (R) and blue (B) lines fail to converge in convex fashion at the horizontal extents of the CRT as shown. FIG. 1E shows S3V mis-convergence. In this pattern, the red (R) and blue (B) lines do not converge as shown. FIG. 1F shows a pattern of geometry known as Top/Bottom Pin. In this pattern, geometry occurs as a "bowing" of the green (G) lines (and of course red and blue lines) at the vertical extents of the CRT.

Normally, mis-convergences are resolved by the deflection Yoke (DY) itself. A Horizontal deflection coil has a Pin-cushion magnetic field and a Vertical coil has a Barrel magnetic field. Each of these magnetic fields yields one or more of the patterns shown in FIGS. 1A thru 1F. In the manufacture of Vertical and Horizontal coils the target objective is to attain zero values for each of the patterns of mis-convergence; i.e., XH=0, HCR=0, PQV=0, PQH=0, S3V=0 and Top/Bottom pin=0.

Heretofore, it has been possible to adjust for mis-convergence in CRTs by changing the winding distribution on Horizontal and Vertical coils. With the advent of the larger screen sizes being produced today and their corresponding wide deflection angles and flat profiles, adjusting for mis-convergence by traditional methods is more difficult.

One attempt to correct deflection mis-convergence requires extra corrective parts on the deflection yoke. For example, U.S. Pat. No. 5,142,205 discloses a deflection yoke having a correction circuit for correcting horizontal and vertical mis-convergence. This technique requires additional electrical components, thereby resulting in increased parts content and assembly costs of the CRT being manufactured. Moreover, the dimensions of the resulting device are increased as a result of the additional parts installed.

Alternatively, the Horizontal coil of the CRT can be re-manufactured in an attempt to simultaneously reduce the mis-convergence phenomena. However, this process is unwieldy and inefficient in a fast assembly process.

The present invention is therefore directed to the problem of developing method and apparatus for adjusting mis-convergence patterns in a CRT, which method and apparatus is suitable for application to a rapid and existing assembly process used to manufacture larger and flatter CRT screens without increasing the cost of manufacture, or size of the device.

SUMMARY OF THE INVENTION

The present invention solves these and other problems by creating a depression in the windings of the horizontal coil at a predetermined location. In particular, the present invention provides a depression in the windings of a horizontal deflection coil of a CRT in a "neck" portion of the deflection yoke, which incorporates a horizontal deflection coil disposed on a saddle type mold die.

According to one aspect of the present invention, a deflection yoke for deflecting electron beams of a color CRT includes a horizontal deflection coil disposed on a saddle type mold die has a funnel section and a neck section connected along a horizontal axis parallel to the centerline of the deflection yoke. A portion of the neck section of the deflection yoke includes an offset relative to the profile (relative to the horizontal axis) of the windings of the horizontal coil that creates a depressed area in the windings of the horizontal deflection coil.

According to another aspect of the invention, in the above deflection yoke, the disposition angle of the horizontal deflection coil relative to the horizontal axis in the neck portion of the depressed area lies within a range between approximately 40 degrees and approximately 60 degrees.

According to another aspect of the invention, in the above deflection yoke the disposition angle of the horizontal deflection coil relative to the horizontal axis in the funnel portion of the depressed area lies within a range between approximately 30 degrees and approximately 45 degrees.

According to yet another aspect of the present invention, in the above deflection yoke, a depth of the offset lies within a range between approximately 0.5 millimeters and approximately 1.0 millimeters.

According to yet another aspect of the present invention, in the above deflection yoke, the mold die assembly comprises a Pin shoot coil winding assembly.

According to another aspect of the present invention, in the above deflection yoke, the depression in the windings of the horizontal deflection coil occurs at a predetermined distance from a beginning of the neck section of the deflection yoke assembly along the horizontal axis through the neck section and funnel sections of the deflection yoke.

According to another aspect of the present invention, a method for simultaneously correcting multiple types of mis-convergence in a deflection yoke of a cathode ray tube having a neck section and a funnel section and a horizontal deflection coil disposed between the neck and funnel section on a saddle type mold die, comprises the following steps. Firstly, a location is selected in the length of the deflection yoke along the horizontal distance between the neck section and the funnel section by dividing said length into four substantially equal sections. Secondly, in a second section of the four substantially equal sections taken from the neck side, along the horizontal axis connecting the neck side to the funnel side, a depression is formed in the windings of the horizontal deflection coil, said depression is relative to the horizontal axis between the neck and funnel sections of the deflection yoke. The depression in the windings creates interference patterns in the electronic fields induced by the horizontal deflection coil that eliminates the multiple types of mis-convergence.

According to another aspect of the present invention, in the above method, the depressed area created in the windings of the horizontal deflection coil is quadrangle shaped.

According to another aspect of the present invention, a device for simultaneously correcting multiple types of mis-convergence includes a deflection yoke further comprising a mold die assembly with a horizontal deflection coil disposed thereon. The deflection yoke is symmetrical about a horizontal axis and has a neck section and funnel section. The profile of the horizontal deflection coil of the deflection yoke is depressed in a portion of the neck section, creating a correction for the mis-convergence of the electron beams in a CRT.

According to another aspect of the present invention, in the above device, the depression in the windings of the horizontal deflection coil is disposed at a predetermined distance from the beginning of the neck section along a horizontal axis between the neck and funnel sections, in the direction of the funnel section.

According to another aspect of the invention, in the above device, the location of the offset is predetermined by first dividing the length of the deflection yoke along the horizontal distance between the neck section and the funnel section into four equal sections and selecting the second section as the area over which to depress the windings of the horizontal deflection coil.

DETAILED DESCRIPTION

It is worthy to note that any reference herein to "one embodiment" or "an embodiment means that a particular feature, structure, or characteristic described in connection with the embodiment is included in at least one embodiment of the invention. The appearance of the phrase "in one embodiment" in various places in the specification are not necessarily all referring to the same embodiment.

The embodiments of the invention include inter alia a method and apparatus for simultaneously correcting various types of mis-convergences in a color CRT. Specifically, the present invention corrects at least XH, HCR, PQV, PQH, S3V mis-convergence and Top/Bottom Pin geometry.

Figure 1A:
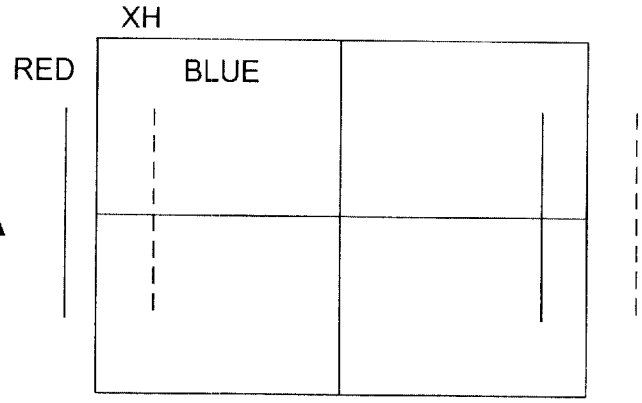
FIG. 1A depicts a pattern of XH mis-convergence.
Figure 1B:
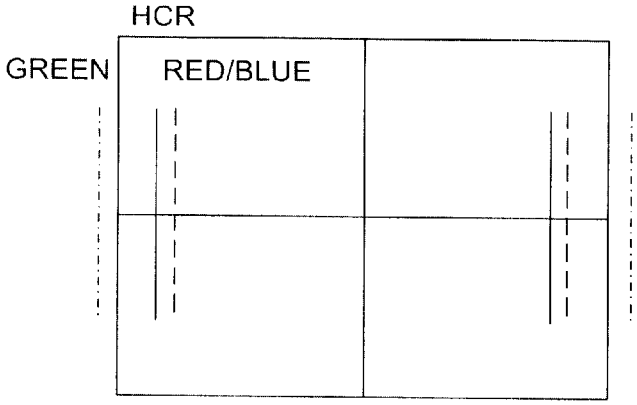
FIG. 1B depicts a pattern of HCR mis-convergence.
Figure 1C:
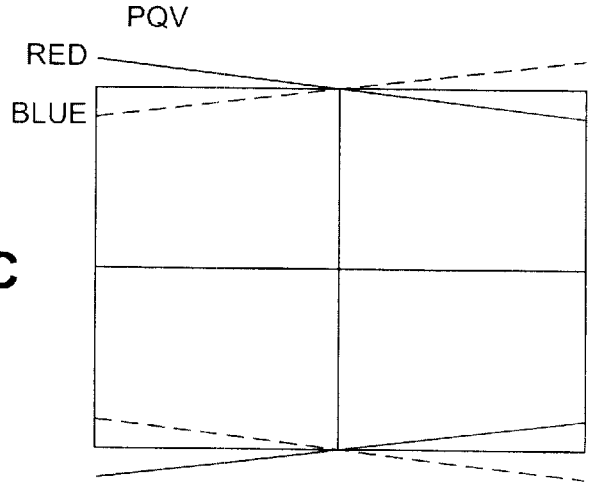
FIG. 1C depicts a pattern of PQV mis-convergence.
Figure 1D:
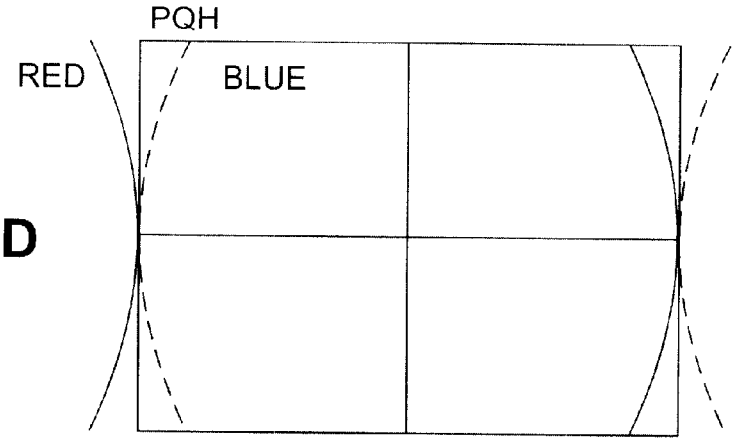
FIG. 1D depicts a pattern of PQH mis-convergence
Figure 1E:
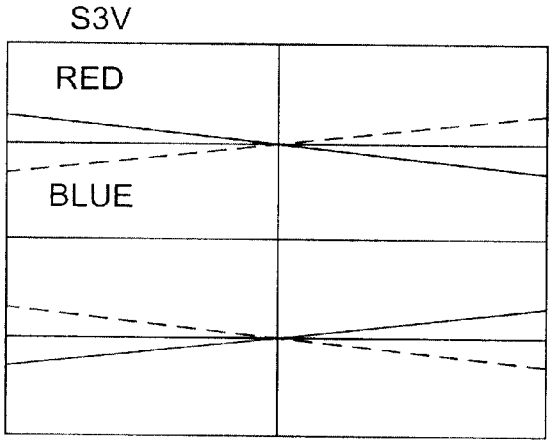
FIG. 1E depicts a pattern of S3V mis-convergence.
Figure 1F:
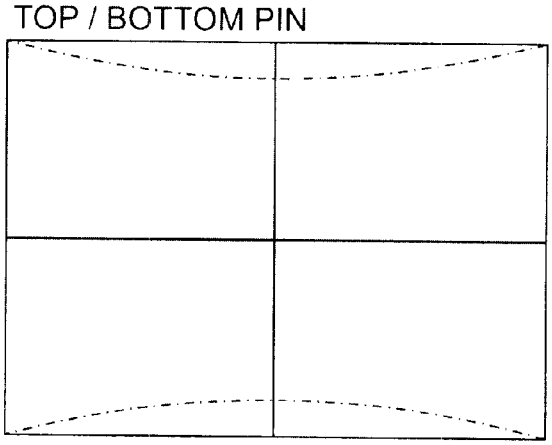
FIG. 1F depicts a pattern of Top/Bottom Pin geometry.
Figure 2A:
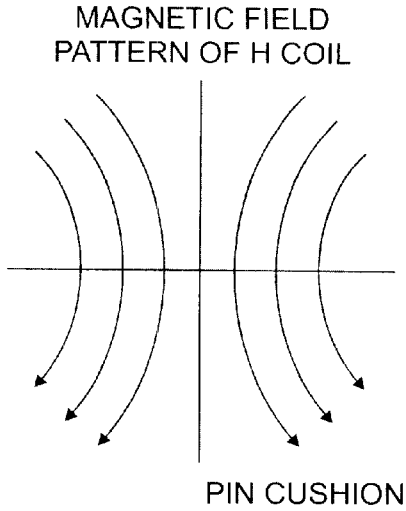
FIG. 2A depicts the magnetic field pattern of a horizontal coil.
Figure 2B:
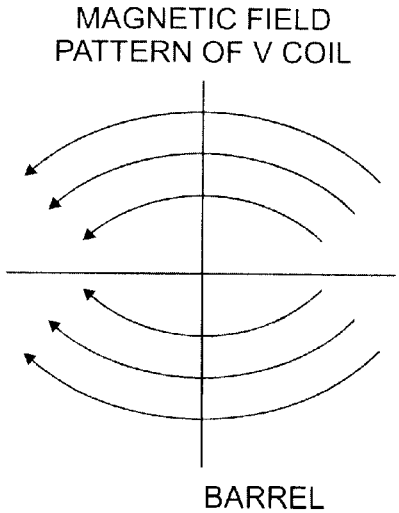
FIG. 2B depicts the magnetic field pattern of a vertical coil.

An exemplary embodiment of a CRT according to one aspect of the present invention employs a deflection yoke with a horizontal deflection coil that has a pin-cushion shaped magnetic field and a vertical deflection coil that has a barrel shaped magnetic field. Each of these magnetic fields yields one or more of the patterns shown in FIGS. 1A–F. These magnetic field patterns are depicted in FIGS. 2A and 2B. Specifically, FIG. 2A depicts the magnetic field pattern of a horizontal deflection coil and FIG. 2B depicts the magnetic field pattern for a vertical deflection coil.

The method and apparatus of the present invention are specific to a horizontal deflection coil and include a horizontal deflection coil assembly disposed on a mold type die. The horizontal deflection coil and the mold die comprise a deflection yoke having a neck section and a funnel section. Referring now to the posterior longitudinal view shown in FIG. 3A, there is depicted therein a deflection yoke comprising a mold die 300 having a neck section 301 and a funnel section 302. FIG. 3B depicts a posterior longitudinal view of a deflection yoke comprising a pin shoot type mold die 303 also having a neck section 301 and funnel section 302. Both deflection yokes 300 and 303 comprise a horizontal deflection coil disposed according to the methods of the present invention.

Figure 3A:
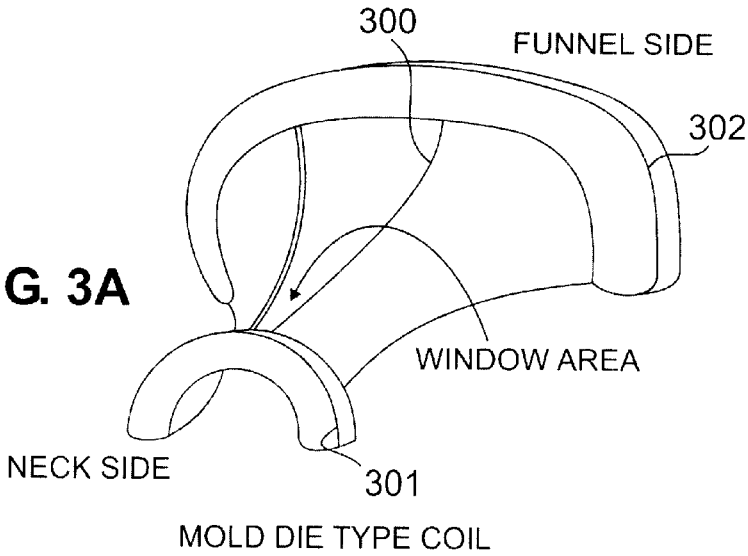
FIG. 3A depicts a posterior view of a longitudinal section of a mold die type deflection yoke comprising a horizontal deflection coil in accordance with the present invention.
Figure 3B:
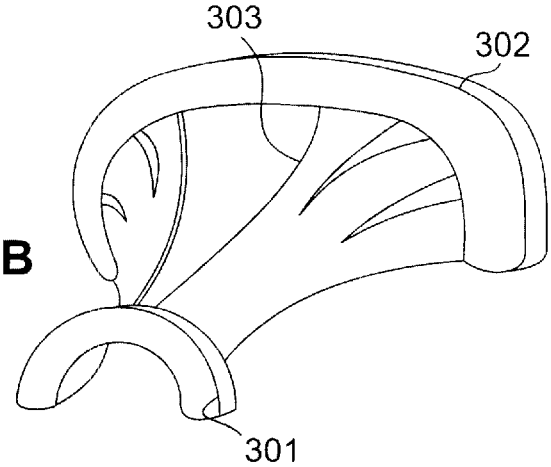
FIG. 3B depicts posterior view of a longitudinal section of a mold die Pin shoot type deflection yoke comprising a horizontal deflection coil in accordance with the present invention.
Figure 4A:
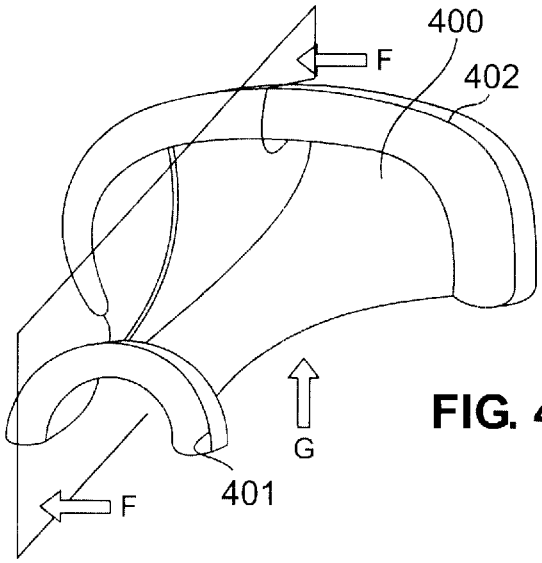
FIG. 4A depicts a posterior view of a longitudinal section of a mold die type deflection yoke comprising a horizontal deflection coil in accordance with the present invention.

As can best be seen in the posterior longitudinal sectional view shown in FIG. 4A, a deflection yoke, which interchangeably incorporates either a mold type die or pin shoot type mold die as shown in FIGS. 3A and 3B, has a neck section 401 and a funnel section 402. As can best be seen in FIG. 4B (depicting section F in FIG. 4A) a horizontal deflection coil (not shown) generally follows the profile of a bottom surface 403 of deflection yoke 400 shown in FIG. 4A. In the present invention, however, to simultaneously correct for the mis-convergences shown in FIGS. 1A through 1F, the profile of the horizontal deflection coil is depressed from a lower surface of the windings of the deflection coil, in an upward direction in an area between neck section 401 and funnel section 402 with respect to horizontal axis 404. This depression is represented as element 405. In practice, altering the profile of the horizontal deflection coil in this fashion shifts the windings of the horizontal coil in the depressed area away from the electron beam of the CRT. The effect of this shift is to reduce the overall magnetic field acting on the electron beam in the depressed area 405 and thereby eliminating mis-convergences in the CRT.

Figure 4B:
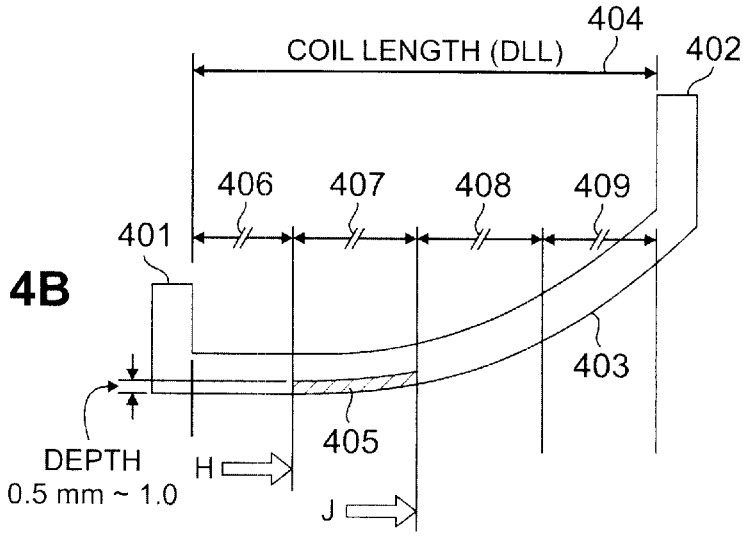
FIG. 4B depicts a longitudinal cross-sectional view of a mold die type deflection yoke comprising a horizontal deflection coil and partitioned in accordance with the present invention.

Depressing the windings in an upward direction (i.e., away from the horizontal axis) has effects on altering the degree of mis-convergence regardless of the location of the depression along the horizontal axis 404 between neck section 401 and funnel section 402, optimal results have been shown to occur in the specific area 407 along the horizontal axis 404. To locate the optimal position for the depressed area 407 and as shown in FIG. 4B, the distance between the neck section 401 and the funnel section 402 is partitioned into four substantially equal portions, 406, 407, 408 and 409. The second partitioned portion 407 measured from the neck section 401 in the direction of the funnel section 402 on the horizontal axis 404, is selected as the optimal location for the depression in the windings of the horizontal coil 405.

Figure 4C:
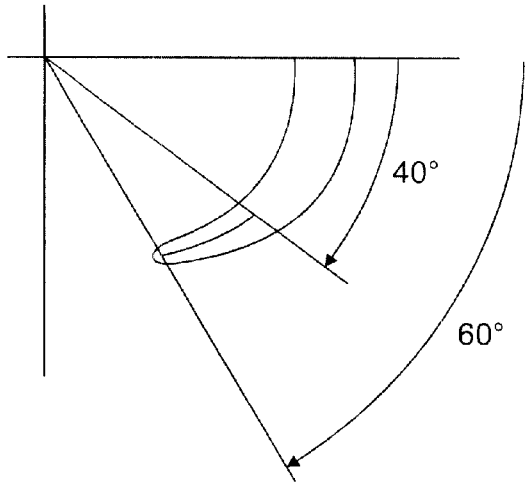
FIG. 4C depicts the angular disposition of the neck side of an area of depressed windings in a horizontal deflection coil in accordance with the present invention.
Figure 4D:
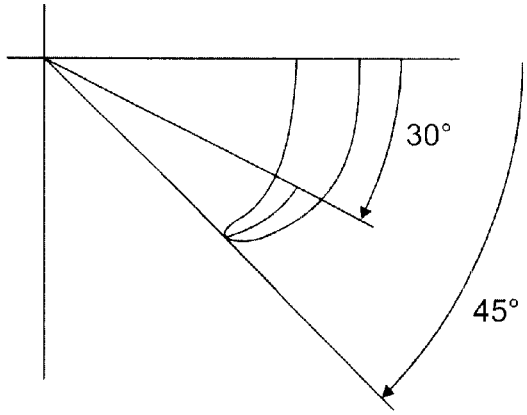
FIG. 4D depicts the angular disposition of the funnel side of an area of depressed windings in a horizontal deflection coil in accordance with the present invention.

As shown in FIG. 4C, in a preferred embodiment of the present invention, apportioning the horizontal length of the deflection yoke 400 in this manner yields a disposition angle of the windings of the horizontal deflection coil in a range of approximately 40 degrees to 60 degrees with respect to the horizontal axis 404 measured to the neck side of depression in the windings of the horizontal deflection coil and, as shown in FIG. 4D, a disposition angle in a range between approximately 30 degrees to approximately 45 degrees with respect to the horizontal axis 404 measured to the funnel side of the depression in the windings of the horizontal deflection coil. While specific values are provided, these values are only approximate and could be modified within a few degrees without departing from the scope of the present invention.

Figure 4E:
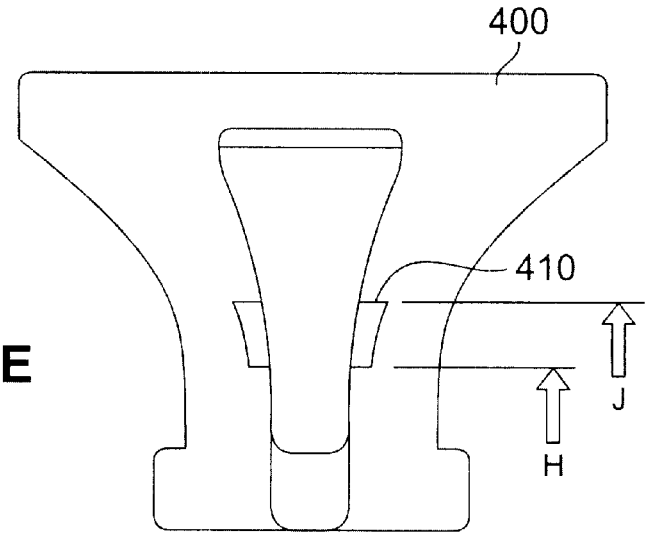
FIG. 4E depicts a planar sectional view of a mold die type deflection yoke comprising a horizontal deflection coil and having a depressed area in the windings of the horizontal coil in accordance with the present invention.

FIG. 4E depicts the deflection yoke 400 of FIG. 4A shown in plan view from below. The depressed area of the windings of the horizontal deflection coil as located by the partitioning of FIG. 4B is depicted by the quadrangle shaped element 410.

In a preferred embodiment of the present invention, the depth of the depressed area in the windings of the horizontal deflection coil is in a range of approximately 0.5 mm to 1.0 mm. While specific values are provided, these values are only approximate and could be modified within a few percent without departing from the scope of the present invention.

Figure 4F:
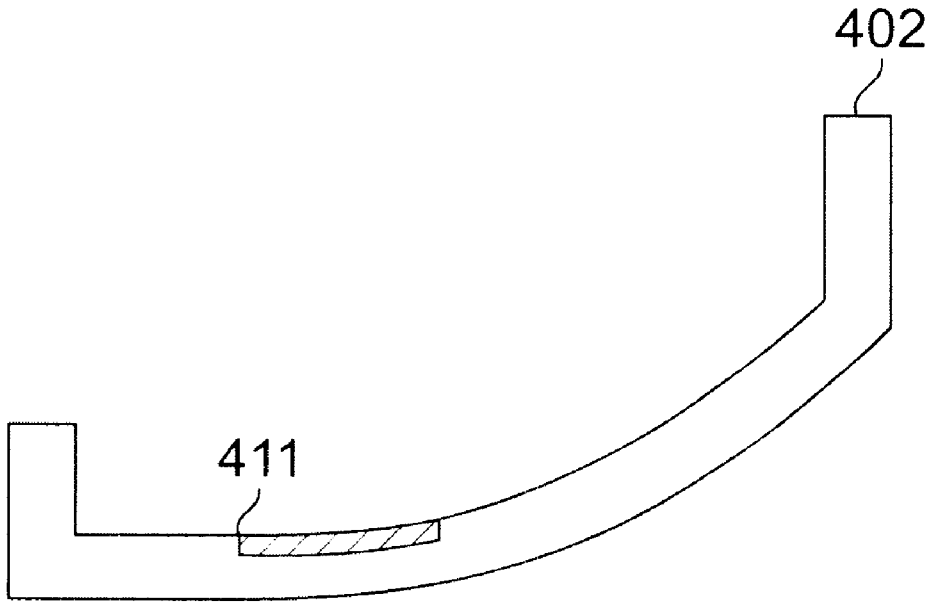
FIG. 4F depicts a longitudinal cross sectional view of the upper half of a mold die type deflection yoke comprising a horizontal deflection coil in accordance with the present invention.

In a second embodiment of the present invention and as shown in the longitudinal cross-section shown in FIG. 4F, the depression 411 in the windings of the horizontal deflection coil is reversed from the example depicted in FIG 4B; i.e., the depression 411 in the windings is made from an upper surface of the deflection coil, in a downward direction with respect to the horizontal axis 404. A depression in the downward direction is warranted in instances where the mis-convergences sought to be corrected are negative (–). In this embodiment, the magnetic field acting on the electron beam is increased, thereby moving the mis-convergence parameters in a direction opposite to that corrected by the embodiment of FIG 4B.

The net effect of the method and apparatus of the present invention is to change the Fourier coefficient of the apparatus without changing the winding distribution of the horizontal deflection coil assembly of the deflection yoke.

According to one exemplary embodiment, a deflection yoke for deflecting electron beams of a color cathode ray tube has at least two sections—a neck section and a funnel section. A horizontal coil is disposed on a saddle type mold die. The windings that make up the horizontal coil generally follow the contours in the saddle type mold die. Moreover, the windings include a depressed area (a depression) disposed at a selected distance along a horizontal axis between the neck and funnel sections of the deflection yoke. The depressed area is depressed relative to the remaining windings of the horizontal deflection coil.

According to another aspect of the present invention, the depressed area has a disposition angle relative to the horizontal axis within a range between approximately 40 degrees and approximately 60 degrees, when measured to a neck side of the depressed area. When measure relative to a funnel side of the depression, the depression has a disposition angle within a range between approximately 30 degrees and 45 degrees. These values are only approximate, however, and may vary within a few degrees on either side of the range.

According to yet another aspect of the deflection yoke, the depressed area is formed in the shape of a quadrangle. This shape has been shown to provide improved performance in the magnetic field of the deflection coil, thereby reducing the mis-convergence in the CRT.

According to yet another aspect of the present invention, the position of the depression in the deflection yoke is selected by apportioning a distance between the neck and funnel side into four sections, and selecting the second section for depressing the windings. Moreover, the depth of the depression is determined to lie between a range between approximately 0.5 mm to approximately 1.0 mm. This depth has been shown to provide improved performance in the magnetic field of the deflection coil, thereby reducing the mis-convergence in the CRT.

With regard to the mold die used in the deflection yoke, one possible type includes a pin shoot saddle type mode die.

According to yet another embodiment of the present invention, a method for simultaneously correcting multiple types of mis-convergence in a cathode ray tube employs a deflection yoke having a neck section and a funnel section. The deflection yoke includes a horizontal deflection coil disposed on a saddle type mold die. The steps of the method include selecting an area in the horizontal deflection coil in which to create a depression in the windings of the horizontal coil by dividing a length of the deflection yoke along a horizontal axis between the neck and funnel sections into four substantially equal portions. Next, the depression is created in the windings in the second of the four substantially equal portions. Moreover, a disposition angle of the depression is controlled such that the disposition angle relative to the horizontal axis lies within a range between approximately 40 degrees and approximately 60 degrees as measured from a neck side of the depression, and within a range between approximately 30 degrees and 45 degrees as measured from a funnel side of the depression.

In the above method, the shape of the depression is controlled to be a quadrangle. Furthermore, the depth of the depression is controlled to within a range between approximately 0.5 mm and approximately 1.0 mm.

According to yet another exemplary embodiment of the present invention, an apparatus for controlling electron beams of a cathode ray tube includes a deflection yoke and a means for correcting multiple types of mis-convergence simultaneously. The deflection yoke controllably deflects the electron beams and includes a neck section, a funnel section, a saddle type mold die, and a horizontal deflection coil, which is disposed on the saddle type mold die. The horizontal deflection coil has a winding distribution that conforms with the contours of the mold die and is symmetric with respect to a horizontal axis between the neck and funnel sections. The means for simultaneously correcting multiple types of mis-convergence is disposed at a predetermined location in the neck section of the deflection yoke along a horizontal axis. This correcting means alters the magnetic field acting on the electron beams to correct for the mis-convergence.

One possible implementation of the correcting means includes a depression in the windings of the horizontal deflection coil, which depression may be shaped in the form of a quadrangle, for example. The depth of the depression should lie between approximately 0.5 mm and approximately 1.0 mm and at a disposition angle between approximately 30 and approximately 45 degrees. Other suitable shapes may be used depending upon the amount of the mis-convergence required to correct.

All the features disclosed in this specification (including any accompanying claims, abstract and drawings), and/or all of the steps or any method or process so disclosed may be combined in any combination, except combinations where at least some of the features and or steps are mutually exclusive. Each feature disclosed in this specification (including any accompanying claims, abstract, and drawings) may be replaced by alternative features serving the same equivalent or similar purpose, unless expressly stated otherwise. Thus unless expressly stated otherwise, each feature disclosed is one example only of a generic series of equivalent or similar features.

Moreover, although various embodiments are specifically illustrated and described herein, it will be appreciated that modifications and variations of the invention are covered by the above teachings and within the purview of the appended claims without departing from the scope of the invention. For example, while a preferred embodiment requires the partitioning of the deflection yoke into four sections by way of determining the optimum location for depressing the windings of the horizontal deflection coil, other partitioning techniques will suffice.

What is claimed is:

1. A deflection yoke for deflecting electron beams of a color cathode ray tube comprising:

a neck section;

a funnel section;

a saddle type mold die; and a horizontal deflection coil disposed on said saddle type mold die and including a plurality of windings generally disposed to follow contours in said saddle type mold die, said windings having an inner surface facing said saddle mold die and an outer surface facing outward from said saddle mold die, said windings having a depressed area depressed from the outer surface of said windings, at a predetermined distance along a horizontal axis between said neck section and said funnel section of said deflection yoke, said depressed area is depressed relative to a remainder of said horizontal deflection coil, said depressed area having a disposition angle relative to said horizontal axis within a range of approximately 40 degrees to approximately 60 degrees measured to a neck side of said depressed area, and a disposition angle within a range of approximately 30 degrees to 45 degrees measured to a funnel side of said depressed area.

2. The deflection yoke according to claim 1, wherein said depressed area comprises a quadrangle shape.

3. The deflection yoke according to claim 1, wherein said predetermined distance is selected by apportioning a distance between said neck side and said funnel side into four sections and selecting a second section of said four sections from said neck side of said deflection yoke for depressing said windings.

4. The deflection yoke according to claim 1, wherein said depressed area comprises a depth between approximately 0.5 mm to approximately 1.0 mm.

5. The deflection yoke according to claim 1, wherein said mold die comprises a pin shoot saddle type mode die.

6. The deflection yoke according to claim 1, wherein said depressed area is formed in a direction away from said horizontal axis.

7. The deflection yoke according to claim 1, wherein said depressed area is formed in a direction towards said horizontal axis.

8. A method for simultaneously correcting multiple types of mis-convergence in a cathode ray tube employing a deflection yoke having a neck section and a funnel section, which deflection yoke includes a horizontal deflection coil disposed on a saddle type mold die, said method comprising:

selecting an area in said horizontal deflection coil in which to create a depression in a plurality of windings in the horizontal coil, the plurality of windings having an inner surface facing the saddle mold die and an outer surface facing outward from the saddle mold die, by dividing a length of said deflection yoke along a, horizontal axis between said neck section and said funnel section into four substantially equal portions; and creating a depression in the plurality of windings of said horizontal deflection coil, the depression depressed from the outer surface of the plurality of windings, in a second one of said four substantially equal portions; and controlling a disposition angle of the depression such that the disposition angle relative to said horizontal axis lies within a range between approximately 40 degrees and approximately 60 degrees as measured from a neck side of the depression, and within a range between approximately 30 degrees and 45 degrees as measured from a funnel side of the depression.

9. The method according to claim 8, further comprising controlling a shape of the depression to be of a quadrangle shape.

10. The method according to claim 8, further comprising controlling a depth of the depression to within a range between approximately 0.5 mm and approximately 1.0 mm.

11. The method according to claim 8, further comprising forming said depression in a direction away from said horizontal axis.

12. The method according to claim 8, further comprising forming said depression in a direction towards said horizontal axis.

13. An apparatus for controlling a plurality of electron beams of a cathode ray tube comprising:

a) a deflection yoke to controllably deflect said plurality of electron beams and including:

(i) a neck section;

(ii) a funnel section;

(iii) a saddle type mold die; and (iv) a horizontal deflection coil disposed on said saddle type mold die, said horizontal deflection coil having a winding distribution conforming with contours of said mold die, the windings having an inner surface facing said saddle type mold die and an outer surface facing outward from said saddle type mold die and being symmetric with respect to a horizontal axis between said neck and funnel sections; and b) means for simultaneously correcting multiple types of mis-convergence, said correcting means consisting of a depression, from the outer surface of the windings, disposed at a predetermined location in said neck section of said deflection yoke along said horizontal axis and altering a magnetic field acting on said plurality of electron beams.

14. The device according to claim 13, wherein said correcting means comprises a depression in said windings of said horizontal deflection coil.

15. The device according to claim 14, wherein said depression is formed in a direction away from said horizontal axis.

16. The device according to claim 14, wherein said depression is formed in a downward towards said horizontal axis.

17. The device according to claim 14, wherein a depth of said depression lies within a range between approximately 0.5 mm and approximately 1.0 mm.

18. The device according to claim 13, wherein said depression lies at a disposition angle within a range between approximately 40 degrees and approximately 60 degrees as measured from a neck side of said depression, and within a range between approximately 30 degrees and approximately 45 degrees as measured from a funnel side of said depression.

19. The device according to claim 13, wherein said depression comprises a quadrangle shape.

20. The device according to claim 13, wherein said predetermined location is determined by: (1) dividing a distance between said neck section and said funnel section into four substantially equal portions; and (2) selecting a second portion of said four substantially equal portions from said neck side as a location for said correcting means.

* * * * *

UNITED STATES PATENT AND TRADEMARK OFFICE

CERTIFICATE OF CORRECTION

PATENT NO. : 6,624,560 B2
DATED : September 23, 2003
INVENTOR(S) : Yoshihiko Usami It is certified that error appears in the above-identified patent and that said Letters Patent is hereby corrected as shown below:

Title page,
Item [57], ABSTRACT, third to last line, after "segments," change ";" to -- , --.

Column 1,
Line 27, after "to", change "mis-conversion" to -- mis-convergence --

Column 2,
Line 32, after "die", change "has" to -- having --.

Column 4,
Line 19, change ""an embodiment means", to -- "an embodiment" means --.

Column 6,
Line 16, after "When," change "measure" to -- measured --.

Column 9,
Line 20, before "towards", change "downward" to -- direction --.

Signed and Sealed this

Twenty-seventh Day of January, 2004

JON W. DUDAS
*Acting Director of the United States Patent and Trademark Office*